US005717275A

United States Patent [19]

Takemura

[11] Patent Number: 5,717,275

[45] Date of Patent: Feb. 10, 1998

[54] MULTI-EMITTER ELECTRON GUN OF A FIELD EMISSION TYPE CAPABLE OF EMITTING ELECTRON BEAM WITH ITS DIVERGENCE SUPPRESSED

[75] Inventor: Hisashi Takemura, Tokyo, Japan

[73] Assignee: NEC Corporation, Tokyo, Japan

[21] Appl. No.: 606,415

[22] Filed: Feb. 23, 1996

[30] Foreign Application Priority Data

Feb. 24, 1995 [JP] Japan ..... 7-037111

[51] Int. Cl.[6] ..... H01J 01/02; H01J 01/16; H01J 19/10

[52] U.S. Cl. ..... 313/309; 313/336; 313/351

[58] Field of Search ..... 313/309, 311, 313/336, 346, 351, 495; 445/50–51

[56] References Cited

U.S. PATENT DOCUMENTS

| | | | |
|---|---|---|---|
| 5,150,019 | 9/1992 | Thomas et al. | 313/309 X |
| 5,514,847 | 5/1996 | Makishima et al. | 313/309 X |
| 5,559,390 | 9/1996 | Makishima et al. | 313/309 X |
| 5,561,345 | 10/1996 | Kuo | 313/495 |
| 5,581,146 | 12/1996 | Pribat et al. | 313/309 |

*Primary Examiner*—Sandra L. O'Shea
*Assistant Examiner*—Mack Haynes
*Attorney, Agent, or Firm*—Foley & Lardner

[57] ABSTRACT

In a multi-emitter electron gun of a field-emission type constructed by the integrated circuit technique, each emitter comprising an emission electrode having an emissive point, an extracting gate electrode, and a focusing electrode, the focusing electrode in a peripheral zone of the multi-emitter electron gun is brought to a lower electric potential as compared with that in a central zone so that the emitter in the peripheral zone has a beam convergence higher than that of the emitter in the central zone. Instead, the focusing electrode in the peripheral zone has a greater thickness as compared with that in the central zone. Alternatively, the focusing electrode in the peripheral zone has a smaller aperture as compared with that in the central zone. Alternatively, the interval between the extracting gate electrode and the focusing electrode is wider in the emitter in the central zone as compared with that in the peripheral zone. Alternatively, the emitter in the peripheral zone alone comprises the focusing electrode of two layers with an upper-layer focusing electrode kept at an electric potential lower than that of a lower-layer focusing electrode. Alternatively, the emitter in the central zone alone further comprises an electrode located between the extracting gate electrode and the focusing electrode and brought to an electric potential substantially equal to that of the extracting gate electrode.

20 Claims, 14 Drawing Sheets

MULTI-EMITTER ELECTRON GUN OF A FIELD EMISSION TYPE CAPABLE OF EMITTING ELECTRON BEAM WITH ITS DIVERGENCE SUPPRESSED

BACKGROUND OF THE INVENTION

This invention relates to an electron gun of a field-emission type with an integrated electrostatic lens and, in particular, to each an electron gun of a multi-emitter type.

Generally, a field-emission type electron gun comprises an electron-emitter element which comprises an emission electrode for emitting electrons, and an extracting gate electrode for extracting the electrons from the emission electrode. The emission electrode may have an acute emissive point to which an electric field is concentrated. The electric field having an adequate intensity and a desired polarity is produced in the vicinity of the emissive point by keeping the extracting gate electrode at an appropriate electric potential higher than that of the emissive point in order to extract the electrons from the emissive point and to accelerate the electrons in the free space. Thus, the electrons are emitted as an output electron beam from the electron gun.

Another field-emission type electron gun, or a multi-emitter electron gun of a field-emission type comprises a plurality of like electron-emitter elements arranged adjacent to one another within a predetermined region in a plane and emits, as an output electron beam, electrons from all of the electron-emitter elements. The multi-emitter electron gun can emit the output electron beam with an increased electron concentration or with an increased beam energy and is, therefore, useful for a large current apparatus.

Each of the field-emission type electron guns described above is generally used in combination with an anode electrode brought to a suitable electric potential in an apparatus, such as a display unit. The electrons emitted from the field-emission type electron gun are predominantly collected at the anode electrode. In order to improve a resolution of an image to be displayed in the display unit, the output electron beam emitted from the field-emission type electron gun must be focused onto the anode electrode. To this end, it is required to provide an electrostatic lens between the field-emission type electron gun and the anode electrode.

As described above, the multi-emitter electron gun comprises a plurality of the electron-emitter elements arranged in a plane and therefore has an emission surface of a wide area.

If the emission electrode of each electron-emitter element has the acute emissive point of a conical shape, the electrons are emitted from a top of the emissive point as an electron beam with a given divergence angle. Thus, the output electron beam emitted from the multi-emitter electron gun reaches the anode electrode over a region wider in area than the emission surface occupied by the electron-emitter elements.

If the output electron beam is highly diverged, the electrostatic lens must be increased in diameter. However, the electrostatic lens of an increased diameter results in a bar to miniaturization of an apparatus, such as a display unit, including the electron gun and the anode electrode. In addition, a high electric energy is required for effective operation of the electrostatic lens of an increased diameter. It is therefore difficult to save power consumption.

In order to avoid the above-mentioned disadvantages, development 18 made of a focusing or converging electrode for suppressing divergence of or for converging the electron beam to thereby avoid an increase of the diameter of the electrostatic lens.

The focusing electrode is provided as an integrated part in each electron-emitter element of the multi-emitter electron gun and is brought to an electric potential lower than that of the extracting gate electrode. Thus, each focusing electrode serves as an electrostatic lens for converging the electron beam passing therethrough.

When the focusing electrode is provided in each electron-emitter element of the apparatus comprising the multi-emitter electron gun and the anode electrode, the electron beam emitted from each emissive point is converged through each focusing electrode, so that the output electron beam is emitted with divergence suppressed from the electron gun towards the anode electrode.

This means that it is not necessary to use a large one of the electrostatic lens between the electron gun and the anode electrode.

However, it has been found out that the multi-emitter electron gun with the focusing electrodes described above has a disadvantage resulting from lowering of the electric potential of each focusing electrode in order to increase convergence of the electron beam, namely, to suppress divergence of the electron beam.

Specifically, when the electric potential of each focusing electrode is lowered, an intensity of the electric field at the top of the emissive point is decreased because the focusing electrode is located in the extreme vicinity of the extracting gate electrode. As a result, the electrons emitted from the emissive point are decreased, so that the output electron beam from the electron gun is also reduced in its intensity. This results in various problems such as a decrease in luminance in the above-mentioned display unit.

As described above, the multi-emitter electron gun of a field-emission type having the conventional focusing electrode is disadvantageous in that convergence of the output electron beam can not be sufficiently increased with the intensity of the output electron beam kept at a high level within an appropriate range. Thus, a so-called trade-off relationship exists between increase of convergence and increase of the intensity of the output electron beam.

SUMMARY OF THE INVENTION

It is an object of this invention to provide a multi-emitter electron gun of a field-emission type capable of increasing convergence of an output electron beam emitted therefrom without substantial decrease of an intensity of an output electron beam emitted therefrom.

According to this invention, a multi-emitter electron gun of a field-emission type comprises a plurality of electron-emitter elements arranged adjacent to one another within a predetermined region on a plane. Each of the electron-emitter elements comprises an emission electrode brought to a first electric potential and having an emissive point for emitting electrons therefrom, an extracting gate electrode spaced at a predetermined interval from said emission electrode to be electrically insulated therefrom, the extracting gate electrode being provided with a first hole for passage of an electron beam composed of the electrons emitted from the emissive point, the extracting gate electrode being brought to a second electric potential higher than the first electric potential, and a focusing electrode spaced at a preselected interval from the extracting gate electrode downstream of the electron beam to be electrically insulated therefrom, the focusing electrode being provided with a second hole for passage of the electron beam after passing through the first hole, the focusing electrode being brought to a third electric potential lower than the second electric potential so as to increase convergence of the electron beam. The electron-emitter elements are classified into peripheral-zone electron-emitter elements located in a peripheral zone of the region and central-zone electron-emitter elements located in a central zone of the region. The convergence of the electron beam is selected to be small in the peripheral-zone electron-emitter elements as compared with the central, zone electron-emitter elements.

In the multi-emitter electron gun comprising a plurality of the electron-emitter elements arranged adjacent to one another, divergence of an output electron beam as a whole is not affected by divergence angles of the electron beams emitted from the central-zone electron-emitter elements. In other words, even if the divergence angles of the electron beams emitted from the central-zone electron-emitter elements are increased, the divergence of the output electron beam is not almost increased as far as the divergence angles of the electron beams emitted from the peripheral-zone electron-emitter elements are not increased. This means it is not necessary to bring the focusing electrodes of the central-zone electron-emitter elements to a decreased electric potential so as to decrease the divergence of the electron beams emitted therefrom.

In this connection, the divergence angles of the electron beams emitted from the peripheral-zone electron-emitter elements are necessary to be decreased because the divergence angle of the output electron beam emitted by the field-emission type electron gun is affected thereby. Thus, the divergence of the output electron beam is suppressed. On the other hand, the divergence angles of the electron beams emitted from the central-zone electron-emitter elements can be increased because they do not affect the divergence of the output electron beam. Accordingly, the focusing electrodes of the central-zone electron-emitter elements are brought to a relatively high electric potential although the focusing electrodes of the peripheral-zone electron-emitter elements are kept at a relatively low electric potential. In this manner, an increased emission current is achieved as a whole.

DETAILED DESCRIPTION OF THE INVENTION

In order to facilitate an understanding of this invention, a known multi-emitter electron gun of a field-emission type will at first be described in detail.

Figure 1:
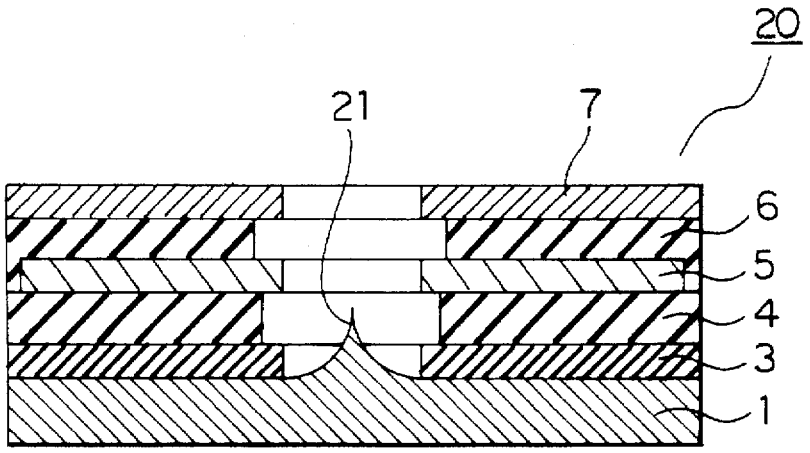
PRIOR ART FIG. 1
FIG. 1 is a sectional view of an electron-emitter element with an acute emissive point for emitting electrons in a known field-emission type electron gun.
Figure 2:
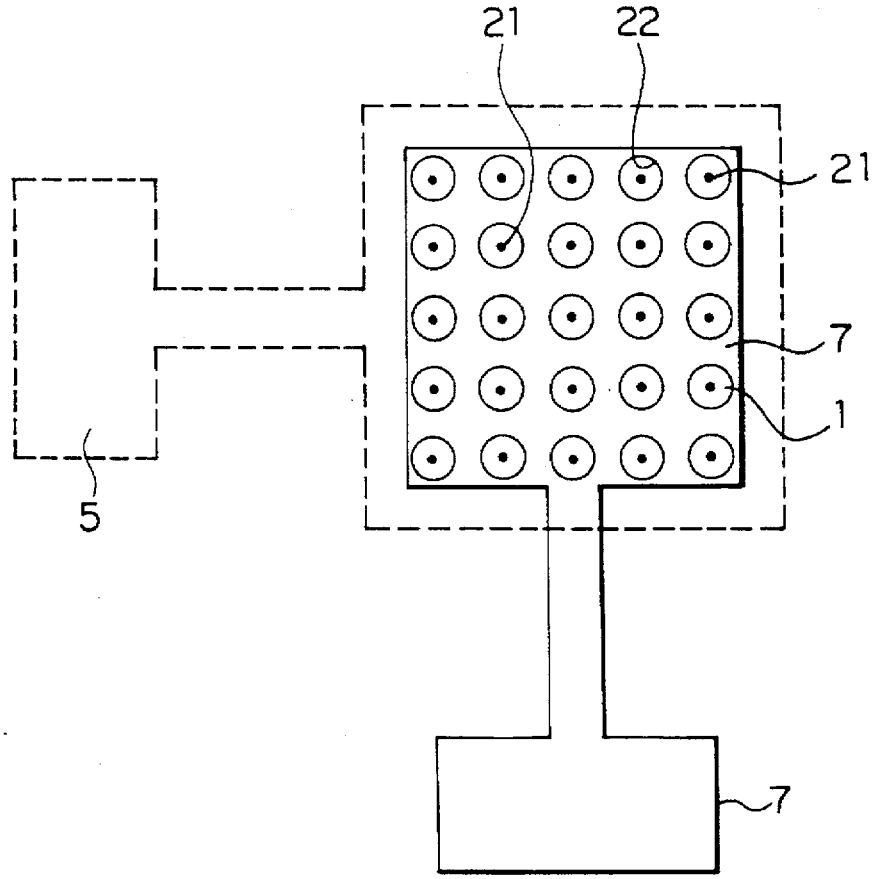
PRIOR ART FIG. 2
FIG. 2 is a schematic plan view of a known multi-emitter electron gun of a field-emission type comprising a plurality of the electron-emitter elements illustrated in FIG. 1 in a matrix arrangement.

Referring to FIGS. 1 and 2, the known multi-emitter electron gun comprises a plurality of electron-emitter elements 20. As illustrated in FIG. 1, each electron-emitter element 20 comprises an emission electrode (for example, a silicon substrate) 1 having an acute emissive point 21 of a conical shape. an insulation layer composed of oxide films 3 and 4 formed on the emission electrode 1 and having a hole for exposing the emission point 21 to permit electrons to emit from the emissive point 21 thereinto, an extracting gate electrode 5 formed on the oxide film 4 and having a hole for passage of the electrons emitted from the emissive point 21, an oxide film 6 formed on the extracting gate electrode 5 and having a hole for passage of the electrons after passing through the extracting gate electrode 5, and a focusing electrode 7 formed on the oxide film 6 and having a hole for passage of the electrons alter passing through the oxide film 6.

Figure 3:
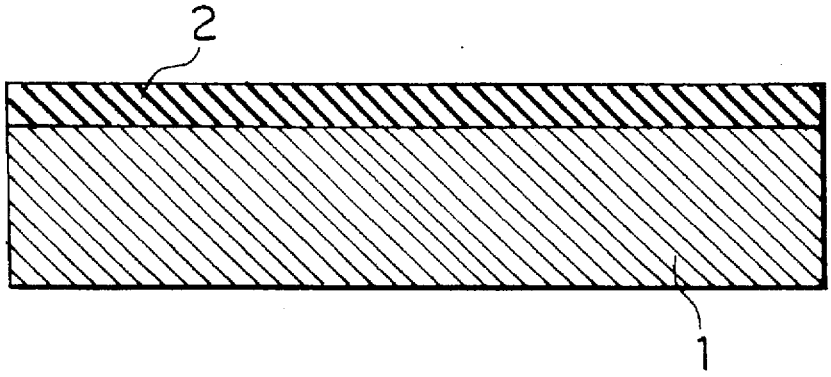
PRIOR ART FIG. 3
FIGS. 3 through 8 show different steps of a conventional manufacturing process of the electron-emitter element having the acute emissive point and a focusing electrode.
Figure 4:
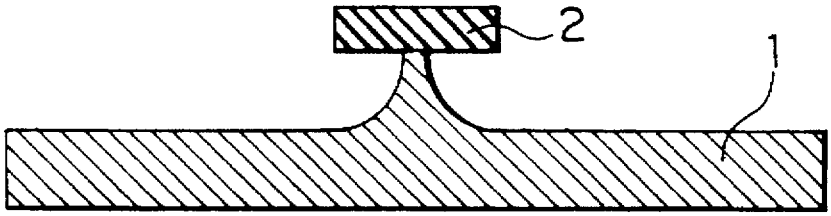
PRIOR ART FIG. 4
Figure 5:
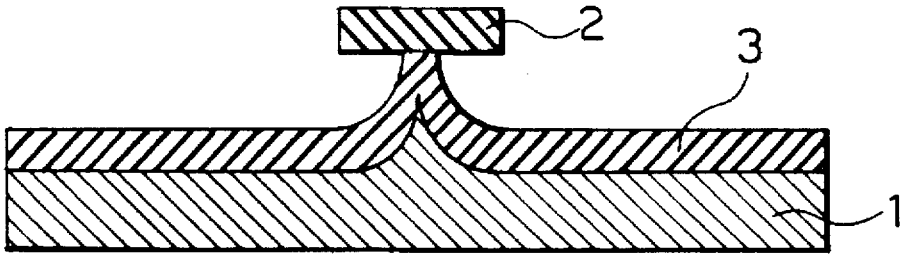
PRIOR ART FIG. 5
Figure 6:
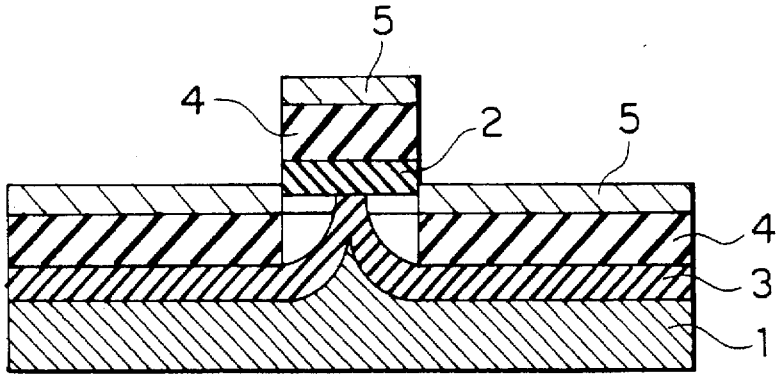
PRIOR ART FIG. 6
Figure 7:
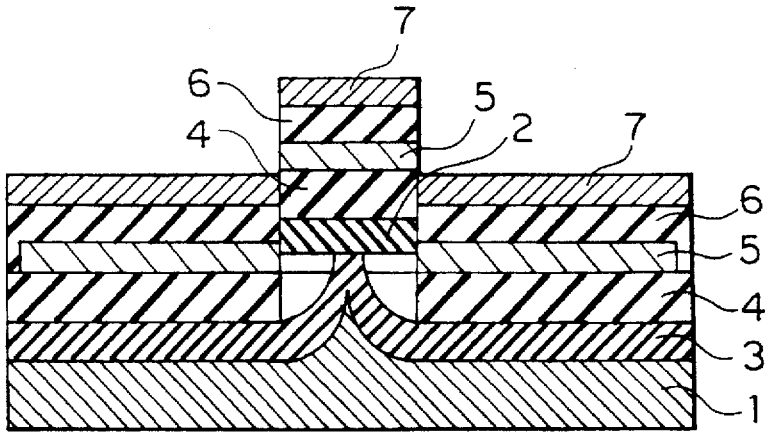
PRIOR ART FIG. 7
Figure 8:
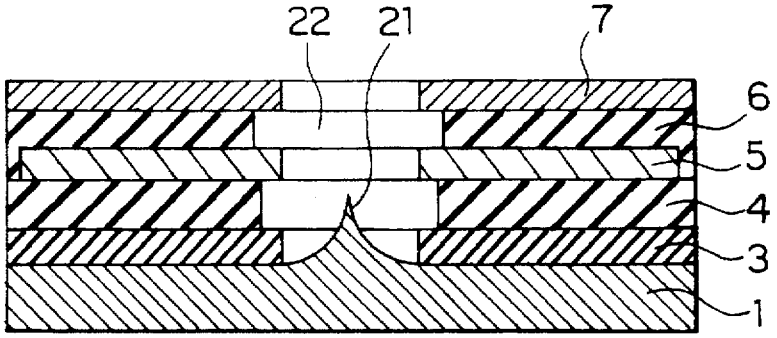
PRIOR ART FIG. 8

The electron-emitter element 20 having the above-mentioned structure is manufactured in a manner which will now be described. As illustrated in FIG. 3, on the emission electrode 1 comprising an n-type silicon substrate, an oxide film 2 having a thickness of, for example, 200 nm is formed by thermal oxidation. Then, as illustrated in FIG. 4, the oxide film 2 is selectively etched using a patterned resist (not shown) of, for example, a circle as a mask. While the oxide film 2 thus etched is in turn used as a mask, the silicon substrate 1 is etched by plasma etching using a gas such as $SF_6$ and also etched under the oxide film 2. As a result, the silicon substrate I has a protuberance. Thereafter, as illustrated in FIG. 5, thermal oxidation is carried out to form the oxide film 3 of a thickness between 200 nm and 400 nm. The protuberance of the silicon substrate 1 is rendered acute to form the emissive point 21 of a conical shape. As illustrated in FIG. 6, the oxide film 4 having a thickness approximately equal to 400 nm and a tungsten film of a thickness of about 200 nm to act as the extracting gate electrode 5 are successively deposited on the oxide film 3 by vapor deposition. As the oxide film 2 is present on the emissive point 21, the oxide film 4 and the extracting gate electrode 5 are also deposited on the oxide film 2. Then, after patterning the extracting gate electrode 5, a 500 nm thick oxide film 6 and a 200 nm thick tungsten film for the focusing electrode 7 are deposited by vapor deposition, as illustrated in FIG. 7. Subsequently, portions of the oxide films 6 and 4 above the emissive point 21 are removed by the use of fluoric acid solution. as illustrated in FIG. 8. Simultaneously, portions of the focusing electrode 7 and the extracting gate electrode 5 above the emissive point 21 are also removed, and the oxide film 2 and a part of the oxide film 3 on the emissive point 21 are removed, too. It is noted here that the oxide film formed by vapor deposition is easily removed as compared with the oxide film formed by thermal oxidation. Accordingly, the resultant electron-emitter element 20 has a hole 22 defined by a slightly uneven wall for exposing the emissive point 21, as shown in FIG. 8.

Figure 9:
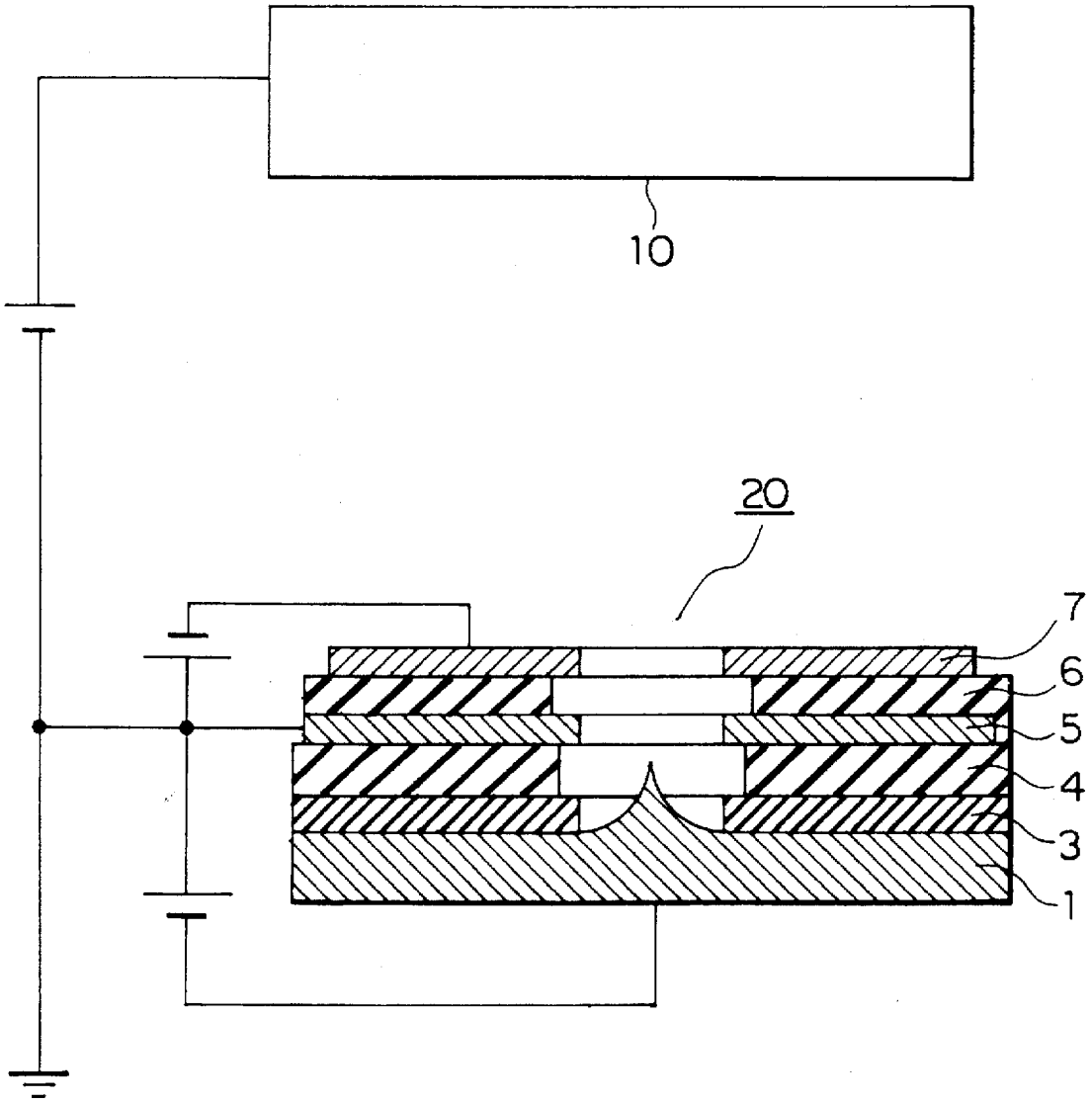
FIG. 9 shows a relationship between the electron gun of a field-emission type and an anode electrode.

A combination of the field-emission type electron gun comprising the electron-emitter element 20 thus manufactured and an anode electrode 10 is shown in FIG. 9.

Generally, in order to obtain a high-level emission current, the field-emission type electron gun comprises a plurality of electron-emitter elements 20 of the above-mentioned structure. For example, the electron-emitter elements 20 are located adjacent to one another in a matrix arrangement to form a multi-emitter electron gun as shown in FIG. 2.

In the known field-emission type multi-emitter electron gun, all of the electron-emitter elements 20 illustrated in FIG. 2 have a similar structure of FIGS. 1 and 8. Emission electrodes 1, extracting gate electrodes 5, focusing electrodes 7, and corresponding oxide films 3, 4, and 6 of all of emitter elements are connected to one another, respectively. Each emission electrode 1, each extracting gate electrode 5, and each focusing electrode 7 are given with predetermined different equipotentials, respectively, as shown in, for example, FIG. 9.

Now, description will be made as regards field-emission type multi-emitter electron guns according to several embodiments of this invention. Throughout the description, similar parts are designated by like reference numerals.

First Embodiment

Figure 10:
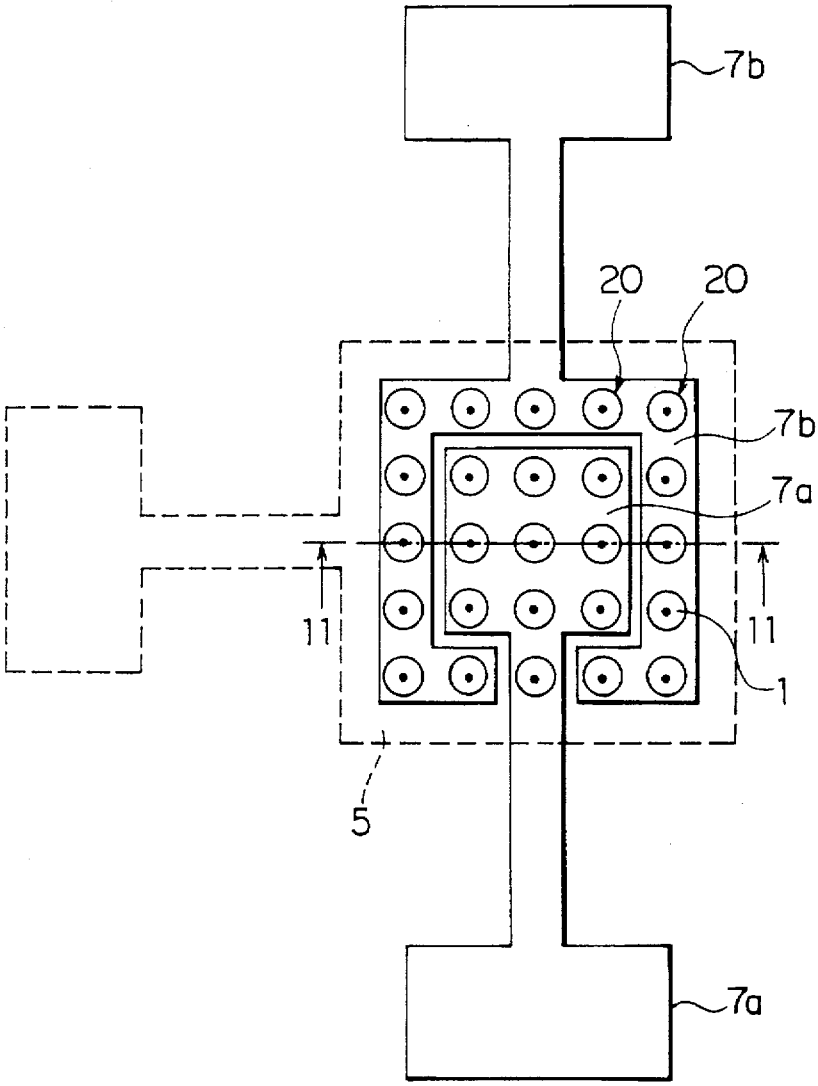
FIG. 10 is a schematic plan view of a multi-emitter electron gun of a field-emission type according to a first embodiment of this invention.
Figure 11:
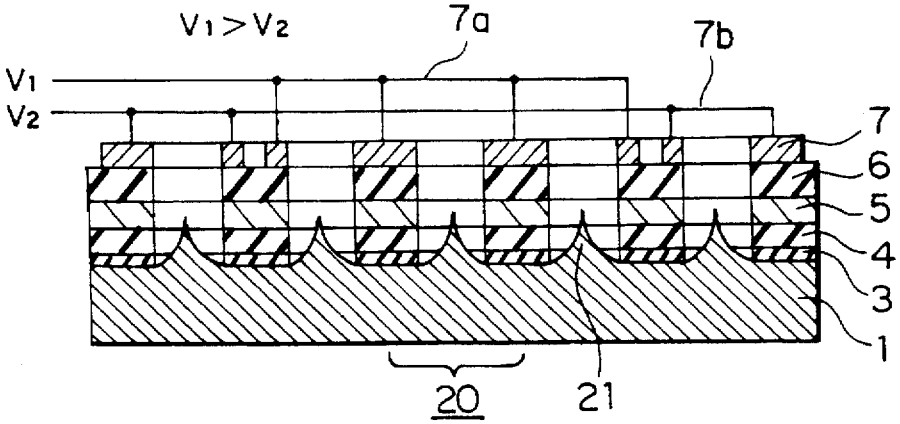
FIG. 11 shows a sectional view taken along a line 11—11 in FIG. 10.

Referring to FIGS. 10 and 11, a field-emission type multi-emitter electron gun according to a first embodiment of this invention comprises a plurality of electron-emitter elements 20 located adjacent to one another in a matrix arrangement in a predetermined region.

Each of the electron-emitter elements 20 has an emission electrode 1 having an acute emissive point 21 for emitting electrons, a first insulation laminate of oxide layers 3 and 4 provided with a hole for exposing the emissive point 21 to permit electrons to emit from the emissive point 21, an extracting gate electrode 5 overlying the oxide layer 4 and provided with a hole for passage of the electrons emitted from the emissive point 21 and electrically insulated from the emission electrode 1 by the presence of the first insulation layers 3 and 4, a second insulation layer 6 formed on the extracting gate electrode 5 and provided with a hole for passage of the electrons after passing through the extracting gate electrode 5, and a focusing electrode 7 overlying the second insulation layer 6 and provided with a hole for passage of the electrons after passing through the second insulation layer 6 and electrically insulated from the extracting gate electrode 5 by the presence of the second insulation layer 6.

The emission electrode 1 is brought to a first electric potential, while the extracting gate electrode 5 is kept at a second electric potential higher than the first electric potential. The focusing electrode 7 is brought to an electric potential lower than the second electric potential.

Referring to FIGS. 10 and 11, emission electrodes 1, extracting gate electrodes 5, and corresponding oxide films 3, 4, and 6 of all of emitter elements are connected to one another, respectively. However, the electron-emitter elements 20 in the first embodiment are classified into first-group electron-emitter elements including those located in a central zone of the matrix arrangement plus one element in an outermost or peripheral zone, and second-group electron-emitter elements including those located in the peripheral zone except the one element belonging to the first-group electron-emitter elements. Focusing electrodes 7*a* of the first-group electron-emitter elements are electrically connected to one another. Likewise, focusing electrodes 7*b* of the second-group electron-emitter elements are electrically connected to one another. In the following description, the focusing electrodes 7*a* and 7*b* of the first-group and the second-group electron-emitter elements will be referred to as first-group and second-group focusing electrodes, respectively. All of the first-group focusing electrodes 7*a* are electrically insulated from all of the second-group focusing electrodes 7*b*.

The first-group focusing electrodes 7*a* are brought to a primary electric potential V1. The second-group focusing electrode 7*b* are kept at a secondary electric potential V2 which is lower than the primary electric potential V1. To this end, two individual power supplies (not shown) are connected to the first-group and the second-group focusing electrodes 7a and 7b, respectively. In order to facilitate an understanding, specific values of the electric potentials at various portions will be given by way of example. when the emission electrodes 1 have an electric potential of 0V and the extracting gate electrodes 5 have an electric potential of 100V, the primary electric potential V1 of the first-group focusing electrodes 7a is selected to be a value between 50V and 100V and the secondary electric potential V2 of the second-group focusing electrodes 7b is selected to be a value between 10V and 50V.

As described, the electric potential of the second-group focusing electrodes 7b located in the peripheral zone except one of the matrix arrangement is lower than that of the first-group focusing electrodes 7a located in the central zone and one in the peripheral zone. Thus, in the central zone, the divergence angle of an electron beam is greater than that in the peripheral zone but the intensity of the emission current is kept high. In the peripheral zone, the intensity of the emission current becomes low but the divergence angle of the electron beam is small.

Accordingly, taking the multi-emitter electron gun as a whole, it is possible to suppress divergence of an output electron beam without much lowering the level of the emission current.

In the first embodiment, leading out of the electrode is performed at the same line of the electrode layer. To this end, one of the focusing electrodes located in the peripheral zone of the matrix arrangement is separately included in the first-group electron-emitter elements. Alternatively, by the use of another electrode layer, it is possible to separate the focusing electrodes of the electron-emitter elements definitely between the peripheral zone and the central zone.

In the first embodiment, the electric potentials of the focusing electrodes are selected to be two different values. However, three or more electric potentials may be adopted. In any event, the electric potentials of the focusing electrodes are selected to be lower in the peripheral zone than in the central zone.

Second Embodiment

Figure 12:
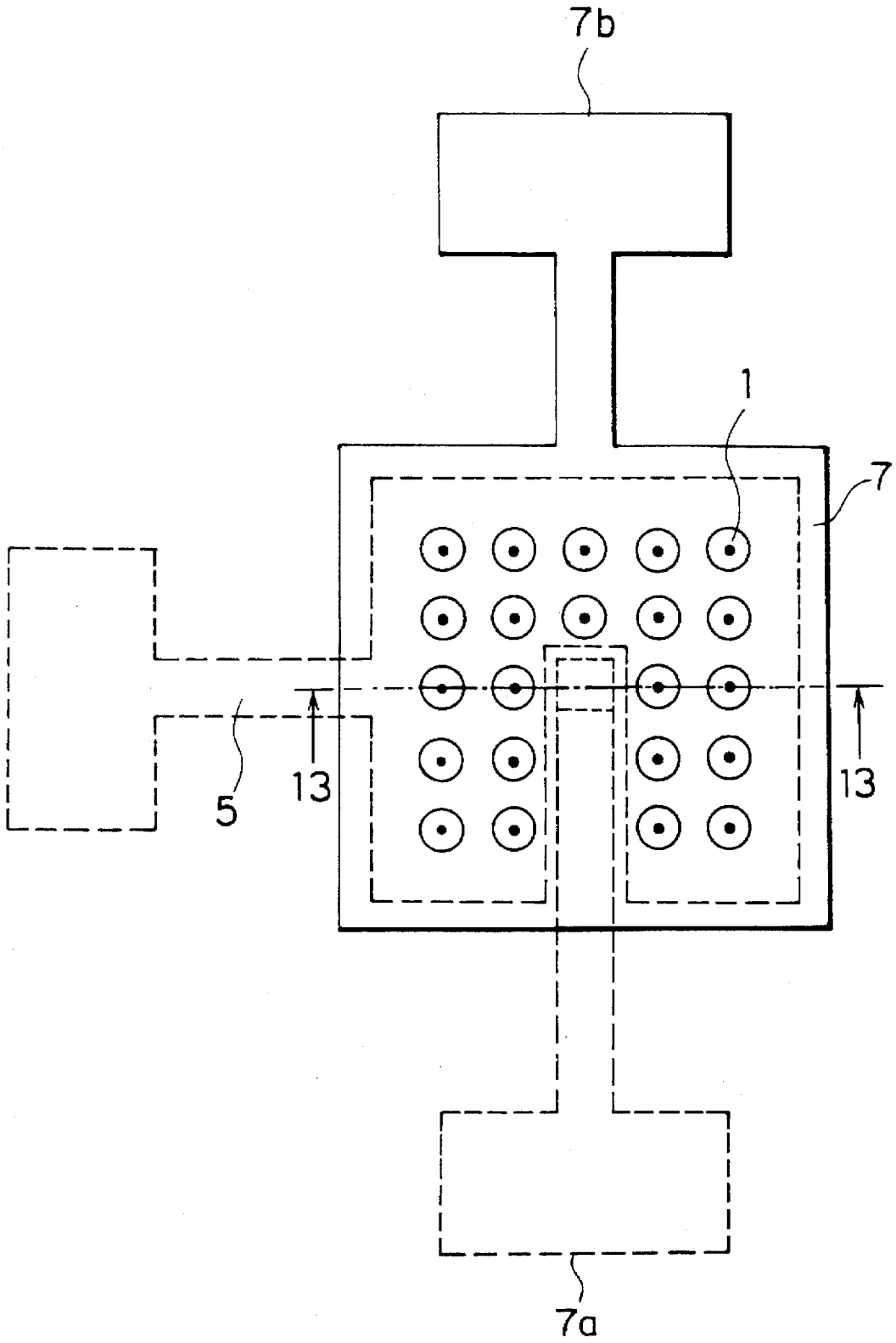
FIG. 12 is a schematic plan view Of a multi-emitter electron gun of a field-emission type according to a second embodiment of this invention.
Figure 13:
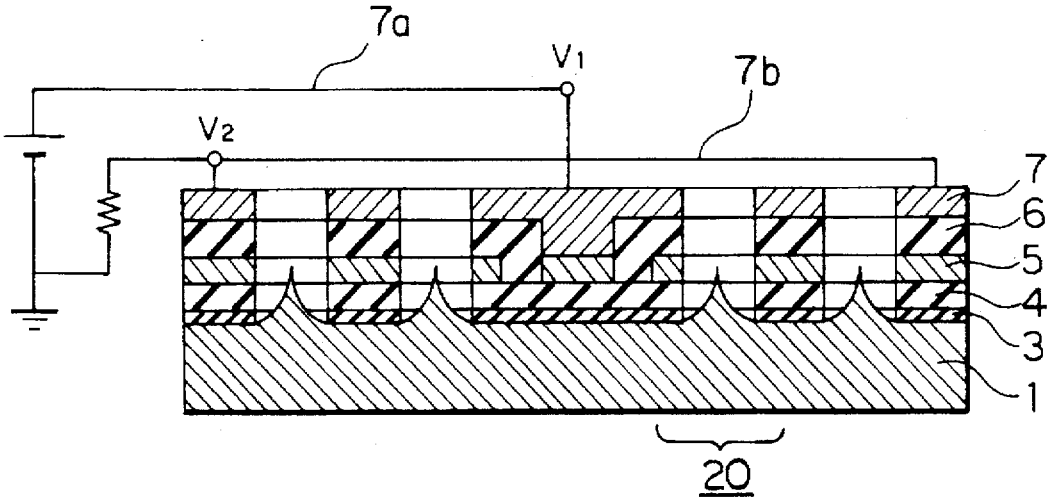
FIG. 13 is a sectional view taken along a line 13—13 in FIG. 12.

Referring to FIG. 12, a field-emission type multi-emitter electron gun according to a second embodiment of this invention comprises a plurality of electron-emitter elements 20 located adjacent to one another in a matrix arrangement in a predetermined region, like in the first embodiment, except that electron emitter elements are not provided along a linear stripe from a central position in the region to the peripheral portion of the region. In the similar manner as in the prior art, emission electrodes 1, extracting gate electrodes 5, and focusing electrodes 7 are connected to one another to form a common emission electrode 1, a common extracting gate electrode 5, and a common focusing electrode 7, respectively, and corresponding oxide films 3, 4, and 6 of all of emitter elements are connected to one another to form common oxide films 3, 4, and 6, respectively. However, the common focusing electrode 7 is led out from its central portion at the center of the region along the linear strip as a lead electrode 7a and is further led out from its peripheral edge as another lead electrode 7b. A voltage is applied across the lead electrodes 7a and 7b from a single power source as shown in FIG. 13. The resistances along the common focusing electrode 7 from its central position to different positions towards the peripheral edge are different from each other so that the secondary electric potential V2 of the focusing electrodes 7 of the electron-emitter elements in the peripheral zone of the matrix arrangement is lower than the primary electric potential V1 of the focusing electrodes 7 of the electron-emitter elements in the central zone of the matrix arrangement. With this structure, a single power supply is sufficient for feeding the focusing electrodes 7 kept at the different electric potentials.

Like in the first embodiment, in this second embodiment also, the electric potentials of the focusing electrodes 7 are lower An the peripheral zone than in the central zone. Thus, in the central zone, the divergence angle of the electron beam is greater than that in the peripheral zone but the intensity of the emission current is kept high. In the peripheral zone, the intensity of the emission current becomes low but the divergence angle of the electron beam is small.

Accordingly, taking the multi-emitter electron gun as a whole, it is possible to suppress divergence of the output electron beam without much lowering the level of the emission current.

Third Embodiment

A field-emission type multi-emitter electron gun according to a third embodiment of this invention comprises a plurality of the electron-emitter elements 20 located adjacent to one another in a matrix arrangement, like in the first embodiment.

Figure 14:
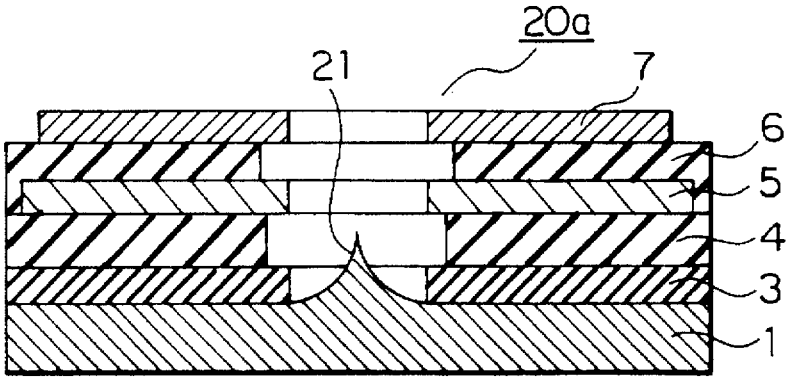
FIG. 14 is a sectional view of an electron-emitter element in a central zone of a multi-emitter electron gun of a field-emission type according to a third embodiment of this invention.
Figure 15:
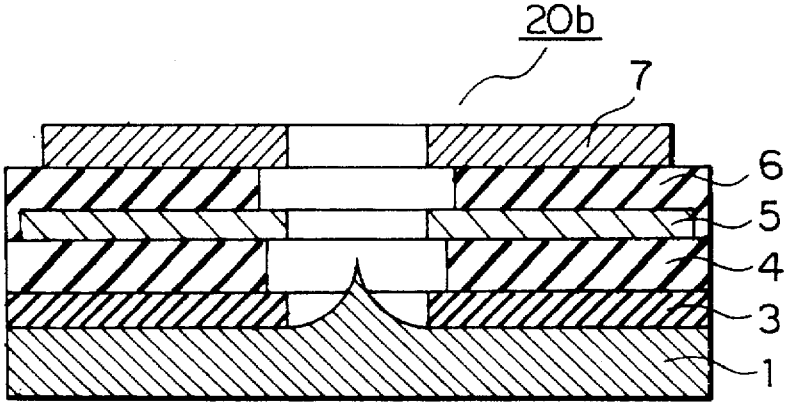
FIG. 15 is a sectional view of an electron-emitter element in a peripheral zone of the multi-emitter electron gun of a field-emission type according to the third embodiment of this invention.

FIG. 14 shows one of the electron-emitter element 20a located in the central zone of the matrix arrangement. FIG. 15 shows one of the electron-emitter elements 20b located in the peripheral zone of the matrix arrangement. The electron-emitter elements 20a and 20b in the central zone and in the peripheral zone will hereinafter be referred to as the central-zone electron-emitter elements and the peripheral-zone electron-emitter elements, respectively. The focusing electrodes 7 of the peripheral-zone electron-emitter elements 20b have a thickness greater than that of the central-zone electron-emitter elements 20a. Again, the focusing electrodes of the central-zone electron-emitter elements 20a and the peripheral-zone electron-emitter elements 20b will be referred to as the central-zone focusing electrodes and the peripheral-zone focusing electrodes, respectively.

For example, the central-zone focusing electrodes 7 have a thickness of about 200 nm while the peripheral-zone focusing electrodes 7 have a thickness of about 400 nm.

In order to differ the thicknesses between the central-zone and the peripheral-zone focusing electrodes 7, various methods are applicable. For example, a material of the focusing electrodes 7 is deposited by vapor deposition to form an electrode layer having a thickness of about 400 nm over the entire region. Then, using a resist as a mask, the electrode layer in the central zone is selectively etched to form the central-zone focusing electrodes 7 having a reduced thickness of 200 nm. Alternatively, the material of the focusing electrodes 7 is preliminarily selectively deposited in the peripheral zone alone. Then, the material of the focusing electrodes 7 is again deposited throughout the entire region to form the focusing electrodes 7 having different thicknesses between the central zone and the peripheral zone.

In the field-emission type multi-emitter electron gun described above, the peripheral-zone focusing electrodes 7 have an increased thickness so that electric fields formed by the peripheral-zone focusing electrodes 7 are hardly affected by various external influences (for example, from the extracting gate electrodes 5, floating electric fields around the focusing electrodes 7, an anode electrode, and so on). Accordingly, the electric fields formed by the peripheral-zone focusing electrodes 7 have an intensity determined exclusively by the potential given to the peripheral-zone focusing electrodes 7 without being weakened. Therefore, electrostatic lenses formed by the peripheral-zone focusing electrodes 7 are thick and exhibit a large lens effect. On the other hand, the central-zone focusing electrodes 7 have a reduced thickness and electric fields formed thereby are readily affected by the external influences to be reduced in intensity. Accordingly, electrostatic lenses formed by the central-zone focusing electrodes 7 exhibit a smaller lens effect as compared with the lenses formed by the peripheral-zone focusing electrodes 7. However, in the central zone, electric fields formed by the extracting gate electrodes 5 are not much affected by the electric fields of a reduced intensity formed by the central-zone focusing electrodes 7. Therefore, the emission current is not decreased but is kept at a sufficiently high level.

In this embodiment, the thicknesses of the focusing electrodes 7 have two different values. If desired, the focusing electrodes 7 may have a greater number of different thicknesses. Alternatively, the thickness may be continuously varied from the central zone to the peripheral zone.

With the above-mentioned structure, in the central zone, the divergence angle of the electron beam is greater than that in the peripheral zone but the intensity of the emission current is kept high. In the peripheral zone, the intensity of the emission current becomes low but the divergence angle of the electron beam is small.

Accordingly, taking the field-emission type electron gun as a whole, it is possible to suppress divergence of the output electron beam without much lowering the level of the emission current.

In the above-described first embodiment, a plurality of the power supplies are required to bring the focusing electrodes 7 to two different potentials. On the other hand, in this third embodiment, a single power supply is sufficient for feeding the focusing electrodes 7. In addition, in the multi-emitter electron gun according to this embodiment, the focusing electrodes 7 need not be electrically insulated one part from the other part in the matrix arrangement. Thus, no separator region is necessary. That is, the focusing electrodes 7 of all of the electron-emitter elements are also connected to form a common focusing electrode, which common focusing electrode is kept at an electric potential lower than that of the common extracting gate electrode 5. This helps miniaturization of the electron gun.

Fourth Embodiment

A field-emission type multi-emitter electron gun according to a fourth embodiment of this invention comprises a plurality of the electron-emitter elements 20 located adjacent to one another in the matrix arrangement in a predetermined region, like in the first embodiment.

Figure 16:
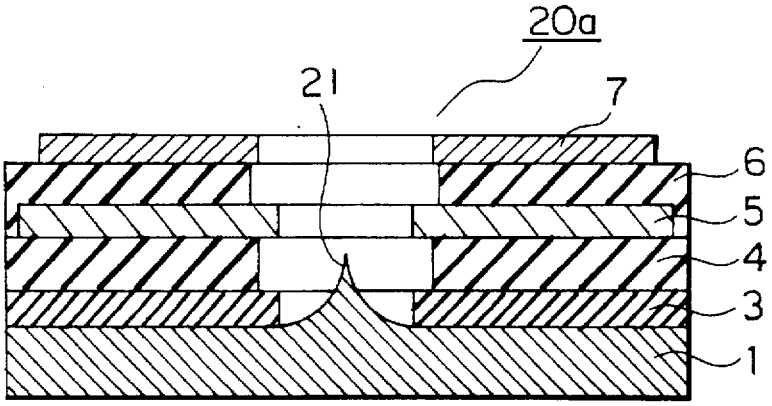
FIG. 16 is a sectional view of an electron-emitter element in a central zone of a multi-emitter electron gun of a field-emission type according to a fourth embodiment of this invention.
Figure 17:
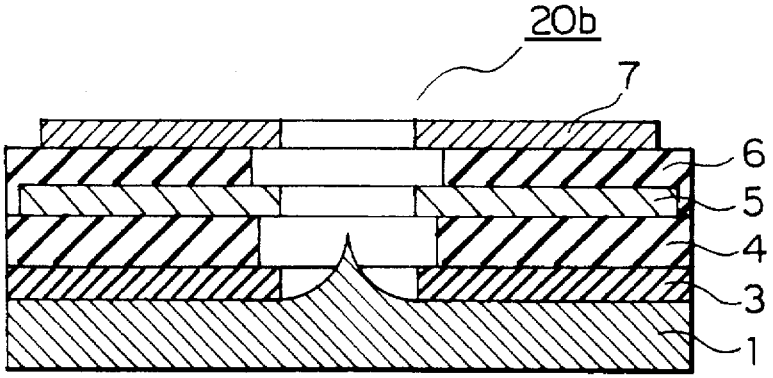
FIG. 17 is a sectional view of an electron-emitter element in a peripheral zone of the multi-emitter electron gun of a field emission type according to the fourth embodiment of this invention.

FIG. 16 shows the one of the central-zone electron-emitter elements 20*a*. FIG. 17 shows one of the peripheral-zone electron-emitter elements 20*b*. The central-zone focusing electrode 7 of the central-zone electron-emitter element 20*a* has a hole which is greater in diameter as compared with that in the peripheral-zone focusing electrode 7 of the peripheral-zone electron-emitter element 20*b*. In order to facilitate an understanding, specific values of the respective portions will be given by way of example. when the diameter of the hole in the extracting gate electrode 5 is substantially equal to 1 μm, the hole of the central-zone focusing electrode 7 has an aperture diameter between about 1.5 and 2 μm while the hole of the peripheral-zone focusing electrode 7 has an aperture diameter between about 1 and 1.5 μm.

It is noted here that the focusing electrodes 7 are kept at the same potential throughout both zones of the matrix arrangement in the similar manner as in the third embodiment.

The focusing electrodes 7 of the above-mentioned structure are easily manufacturing in various manners. For example, in the step of manufacturing the conventional electron-emitter elements 20 as illustrated in FIG. 7, an additional step is included. Specifically, patterning is carried out using a mask such as a resist to make the focusing electrodes have the different aperture diameters. Thereafter, etching is carried out as illustrated in FIG. 8.

Generally speaking, the intensity of an electric field formed by an electrode becomes weak with an increase of the distance from the electrode.

In this embodiment, the central-zone focusing electrode 7 has an aperture diameter greater than that of the peripheral-zone focusing electrode 7. With this structure, a high-level emission current flows in the central zone although convergence the electron beam is reduced. In the peripheral zone on the other hand, convergence of the electron beam is increased although the emission current has a low level.

In this embodiment, the focusing electrodes 7 of the two different aperture diameters are used. Alternatively, the focusing electrodes 7 may have a greater number of different aperture diameters. Further alternatively, the aperture diameter may be gradually increased from the central-zone electron-emitter elements towards the peripheral-zone electron-emitter elements.

With the above-mentioned structure, in the central zone, the divergence angle of the electron beam is greater than that An the peripheral zone but the intensity of the emission current is kept high. In the peripheral zone, the intensity of the emission current becomes low but the divergence angle of the electron beam is small.

Accordingly, taking the field-emission type electron gun as a whole, it is possible to suppress divergence of the output electron beam without much lowering the level of the emission current.

Fifth Embodiment

A field-emission type multi-emitter electron gun according to a fifth embodiment of this invention comprises a plurality of the electron-emitter elements 20 located adjacent to one another in the matrix arrangement in a predetermined region, like in the first embodiment.

Figure 18:
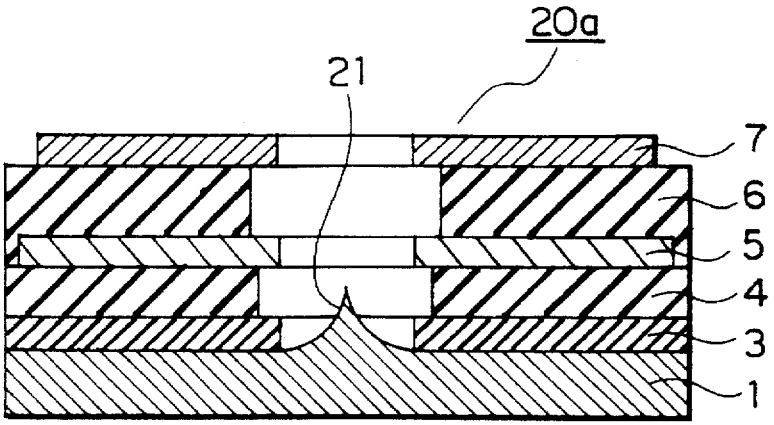
FIG. 18 is a sectional view of an electron-emitter element in t central zone of a multi-emitter electron gun of a field-emission type according to a fifth embodiment of this invention.
Figure 19:
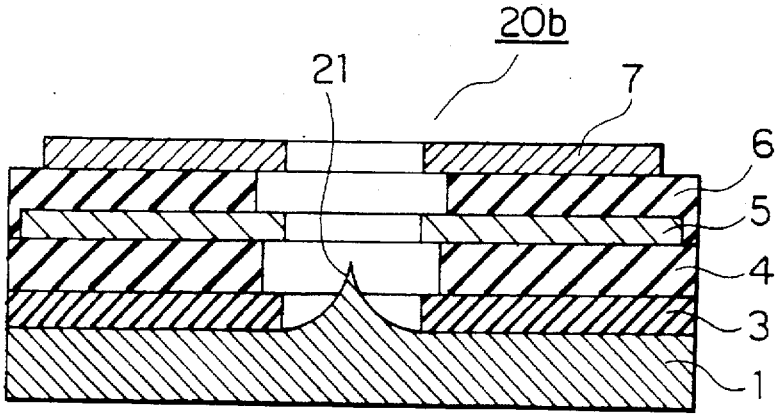
FIG. 19 is a sectional view of an electron-emitter element in a peripheral zone of the multi-emitter electron gun of a field-emission type according to the fifth embodiment of this invention.

FIG. 18 shows one of the central-zone electron-emitter elements 20*a*. FIG. 19 shows the peripheral-zone electron-emitter elements 20*b*. In the central-zone electron-emitter elements 20*a*, the second insulation layer 6 comprising the oxide film has a greater thickness as compared with the peripheral-zone electron-emitter elements 20*b*.

In other words, the central-zone focusing electrode 7 is spaced by a relatively large distance from the extracting gate electrode 5 while the peripheral-zone focusing electrode 7 is spaced by a relatively small distance from, that is, comparatively close to the extracting gate electrode 5.

The electron-emitter elements 20 are manufactured in various manners. For example, after the step illustrated in FIG. 6, the extracting gate electrode 5 is patterned. An oxide film is deposited throughout the entire region to a thickness of, for example, about 200 nm. The oxide film in the peripheral zone is selectively etched and removed to leave the oxide film in the central zone alone. Thereafter, the oxide film is again deposited to a thickness of, for example, 200 nm throughout the entire region. The subsequent steps are similar to those of the conventional process as illustrated in FIGS. 7 and 8.

With this structure, the electron beam passing through the extracting gate electrode in the peripheral zone is immediately subjected to the lens effect of the focusing electrode 7 in comparison with that in the central zone. In addition, the electric field intensity of the emissive point 21 is decreased in the peripheral zone in comparison with that in the central zone. Thus, in the peripheral zone, the emission current has a relatively low level while convergence of the electron beam is increased. In comparison with the peripheral zone, the electron beam passing through the extracting gate electrode in the central zone is not substantially affected by the focusing electrodes 7. In addition, the electric field intensity of the emissive point 21 in the central zone is hardly affected by the focusing electrodes 7. Thus, the emission current in the central zone is kept at a relatively high level while convergence the electron beam is reduced.

In this embodiment, the second insulation layer has two different thicknesses. If desired, the second insulation layer may have a greater number of different thicknesses. Alternatively, the thickness may be gradually reduced from the central zone towards the peripheral zone.

With the above-mentioned structure, in the central zone, the divergences angle of the electron beam is greater than that in the peripheral zone but the intensity of the emission current is kept high. In the peripheral zone, the intensity of the emission current becomes low but the divergence angle of the electron beam is small.

Accordingly, taking the field-emission type electron gun as a whole, it is possible to suppress divergence of the output electron beam without much lowering the level of the emission current.

Even in this embodiment, the focusing electrodes 7 of all of the electron-emitter elements are also connected to form a common focusing electrode, which common focusing electrode is. kept at an electric potential lower than that of the common extracting gate electrode 5.

Sixth Embodiment

A field-emission type multi-emitter electron gun according to a sixth embodiment of this invention comprises a plurality of the electron-emitter elements 20 located adjacent to one another in a matrix arrangement in a predetermined region, like in the first embodiment.

Figure 20:
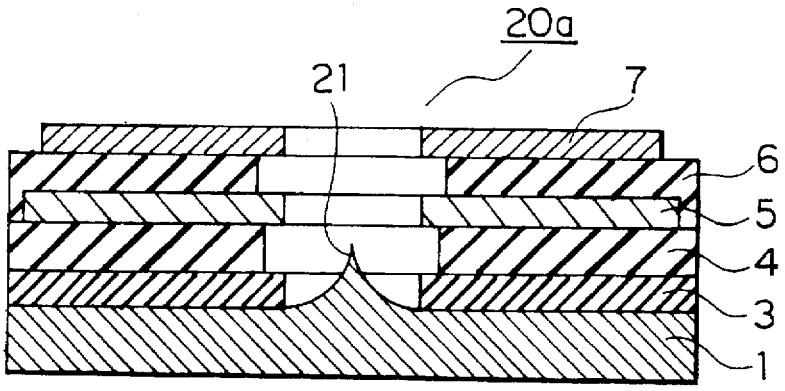
FIG. 20 is a sectional view of an electron-emitter element in a central zone of a multi-emitter electron gun of a field-emission type according to a sixth embodiment of this invention.
Figure 21:
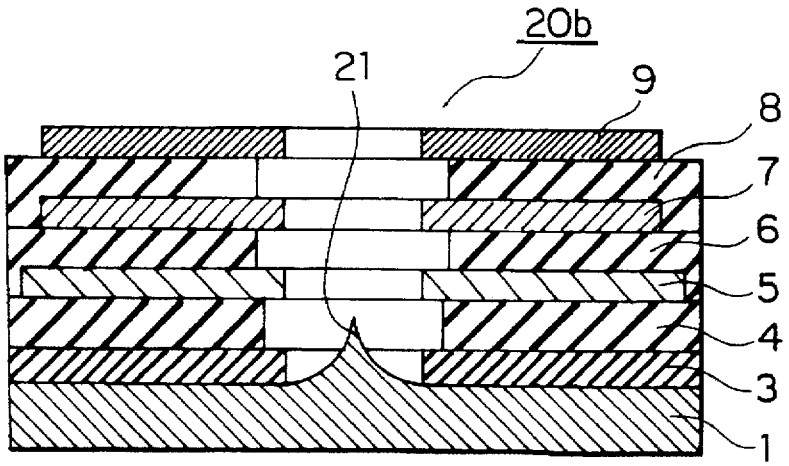
FIG. 21 is a sectional view of an electron-emitter element in a peripheral zone of the multi-emitter electron gun of a field-emission type according to the sixth embodiment of this invention.

FIG. 20 shows one of the central-zone electron-emitter elements 20*a*. FIG. 21 shows one of the peripheral-zone electron-emitter elements 20*b*. The central-zone electron-emitter element 20*a* has a structure similar to the conventional electron-emitter element. The peripheral-zone electron-emitter element 20*b* additionally includes a third insulation layer 8 and an upper focusing electrode 9. In this connection, the focusing electrode will be referred to herein as the lower focusing electrode. Thus, the peripheral-zone electron-emitter element 20*b* comprises the lower and the upper focusing electrodes 7 and 9 In a two-stack arrangement.

Generally, with the focusing electrodes in such a two-stack arrangement, the electric field caused by the electric potential of the upper focusing electrode hardly affects the electric field formed by the extracting gate electrode 5. This is because the electric potential of the lower focusing electrode serves as a mask.

Taking the above into consideration, the electric potential of the lower focusing electrode 7 is rendered higher than that of the upper focusing electrode 9 to approach that of the extracting gate electrode 5. As a consequence, the intensity of the electric field between the extracting gate electrode 5 and the emissive point 21 is prevented from being reduced under the influence of the lower focusing electrode 7.

In this condition, the electric potential of the upper focusing electrode 9 is lowered to thereby increase the lens effect. Thus, both a high-level emission current and an increased convergence can be achieved.

As described, convergence is increased in the peripheral zone with the emission current kept high as a whole. Thus, it is possible for the field-emission type electron gun as a whole to suppress divergence of the electron beam with the emission current substantially kept high.

Even in this embodiment, the focusing electrodes 7 of all of the electron-emitter elements are also connected to form a common focusing electrode, which common focusing electrode is kept at an electric potential lower than that of the common extracting gate electrode 5. The upper focusing electrodes 9 are provided in the peripheral zone and are supplied with an electric potential lower than that of the focusing electrodes 7. However, the number of stacked conductive layers is not restricted to ,a particular number at all.

Seventh Embodiment

A field-emission type multi-emitter electron gun according to a seventh embodiment of this invention comprises a plurality of the electron-emitter elements 20 located adjacent to one another in a matrix arrangement in a predetermined region, like In the first embodiment.

Figure 22:
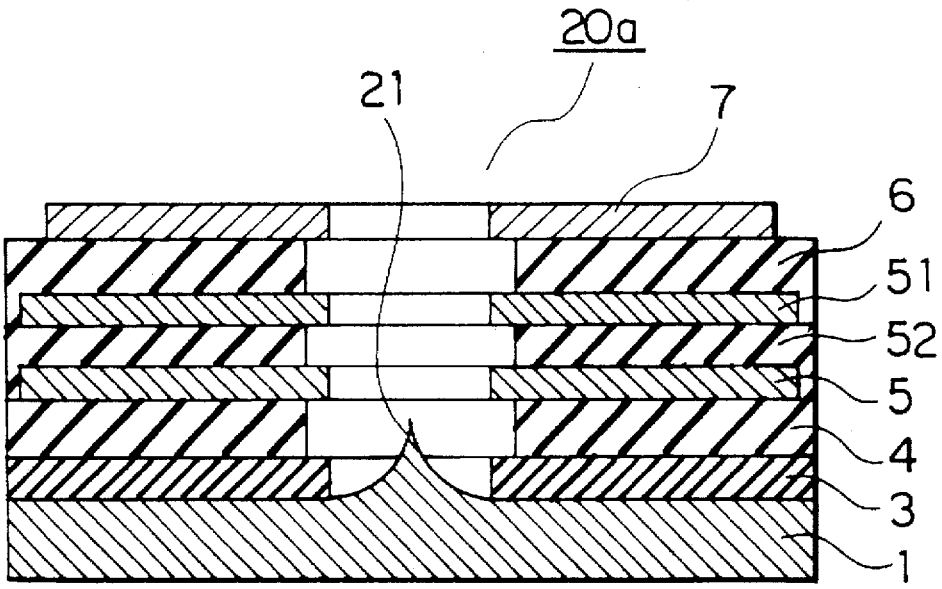
FIG. 22 is a sectional view of an electron-emitter element in a central zone of a multi-emitter electron gun of a field-emission type according to a seventh embodiment of this invention.
Figure 23:
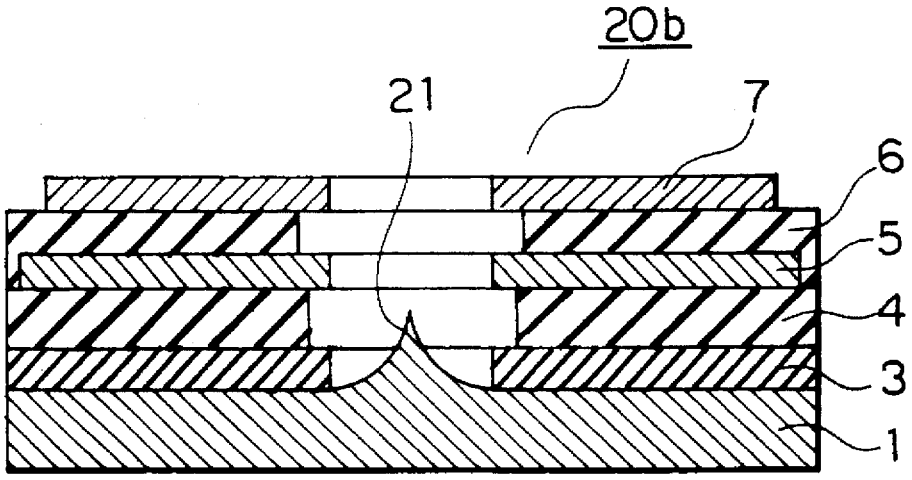
FIG. 23 is a sectional view of an electron-emitter element in a peripheral zone of the multi-emitter electron gun of a field-emission type according to the seventh embodiment of this invention.

FIG. 22 shows one of the central-zone electron-emitter elements 20*a*. FIG. 23 shows one of the peripheral-zone electron-emitter elements 20*b*. The peripheral-zone electron-emitter element 20*b* has a structure similar to the conventional electron-emitter element. The central-zone electron-emitter element 20*a* has, between the extracting electrode 5 and the focusing electrode 7, another electrode 51 and another oxide film 52. The electrode 51 is brought to an electric potential substantially equal to or higher than the electric potential of the extracting gate electrode 5.

With the central-zone electron-emitter element 20*a* of the above-mentioned structure, it is possible to suppress the intensity of the electric field between the extracting gate electrode 5 and the emissive point 21 from being reduced by the electric field caused by the electric potential of the focusing electrode 7. This results in increase of the emission current.

However, convergence of the electron beam is decreased by an electron acceleration effect exerted by the electrode 51.

With the above-mentioned structure, in the central zone, the divergence angle of the electron beam is greater than that in the peripheral zone but the intensity of the emission current is relatively kept high. In the peripheral zone, the intensity of the emission current becomes relatively low but the divergence angle of the electron beam is relatively small.

In this embodiment, emission electrodes 1, extracting gate electrodes 5, and focusing electrodes 7 are connected to one another to form a common emission electrode 1, a common extracting gate electrode 5, and a common focusing electrode 7, respectively, and corresponding oxide films 3, 4, and 6 of all of emitter elements are connected to one another to form common oxide films 3, 4, and 6, respectively. However, in the central-zone electron-emitter elements, two layers of the insulation films 52 and the electrodes 51 are formed between the extracting gate electrodes 5 and the oxide layers 6 and are connected to one another, respectively.

Eight Embodiment

A field-emission type multi-emitter electron gun according to an eighth embodiment of this invention comprises a plurality of the electron-emitter elements 20 located adjacent to one another in a matrix arrangement in a predetermined region, like in the first embodiment.

Figure 24:
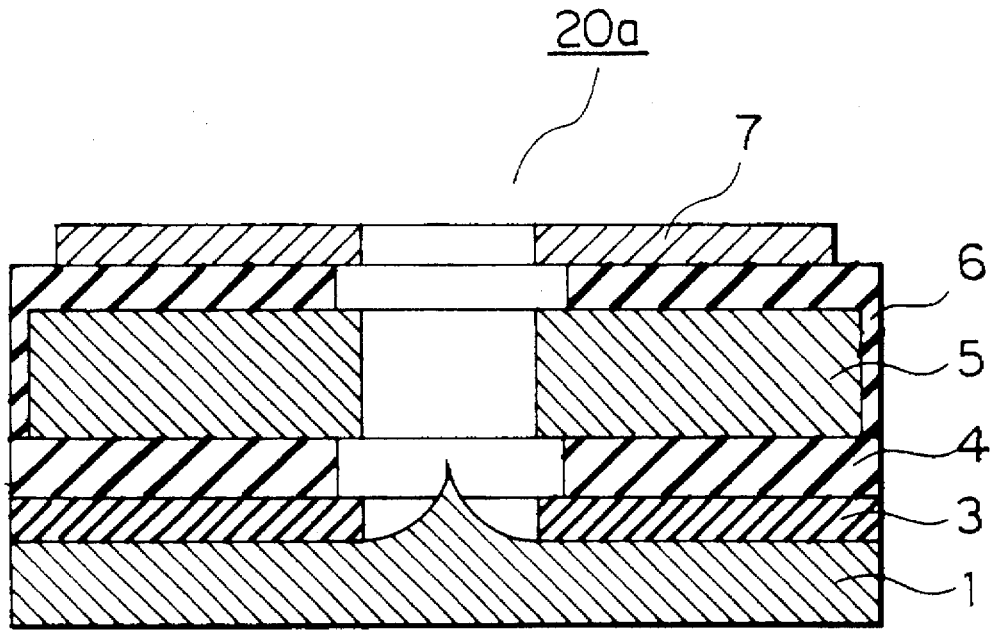
FIG. 24 is a sectional view of an electron-emitter element in a central zone of a multi-emitter electron gun of a field-emission type according to an eighth embodiment of this invention.
Figure 25:
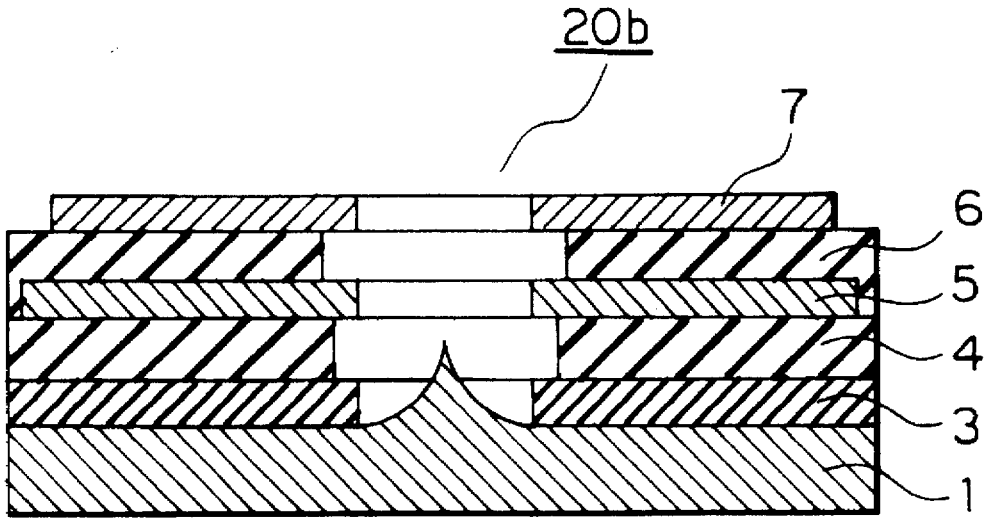
FIG. 25 is a sectional view of an electron-emitter element in a peripheral zone of the multi-emitter electron gun of a field-emission type according to the eighth embodiment of this invention.

FIG. 24 shows one of the central-zone electron-emitter elements 20*a*. FIG. 25 shows one of the peripheral-zone electron-emitter elements 20*b*. The extracting gate electrode 5 of the central-zone electron-emitter element 20*a* has a greater thickness as compared with the peripheral-zone electron-emitter element 20*b*.

This eighth embodiment is a modification of the seventh embodiment. According to the similar principle, in the central zone, the divergence angle of the electron beam is greater than that in the peripheral zone but the intensity of the emission current is kept relatively high. In the peripheral zone, the intensity of the emission current becomes low but the divergence angle of the electron beam is small.

Even in this embodiment, emission electrodes 1, extracting gate electrodes 5, and focusing electrodes 7 are connected to one another to form a common emission electrode 1, a common extracting gate electrode 5, and a common focusing electrode 7, respectively, and corresponding oxide films 3, 4, and 6 of all of the emitter elements are connected to one another to form common oxide films 3, 4, and 6, respectively.

Ninth Embodiment

A field-emission type multi-emitter electron gun according to a ninth embodiment of this invention comprises a plurality of the electron-emitter elements 20 located adjacent to one another in a matrix arrangement in a predetermined region, like in the first embodiment.

Figure 26:
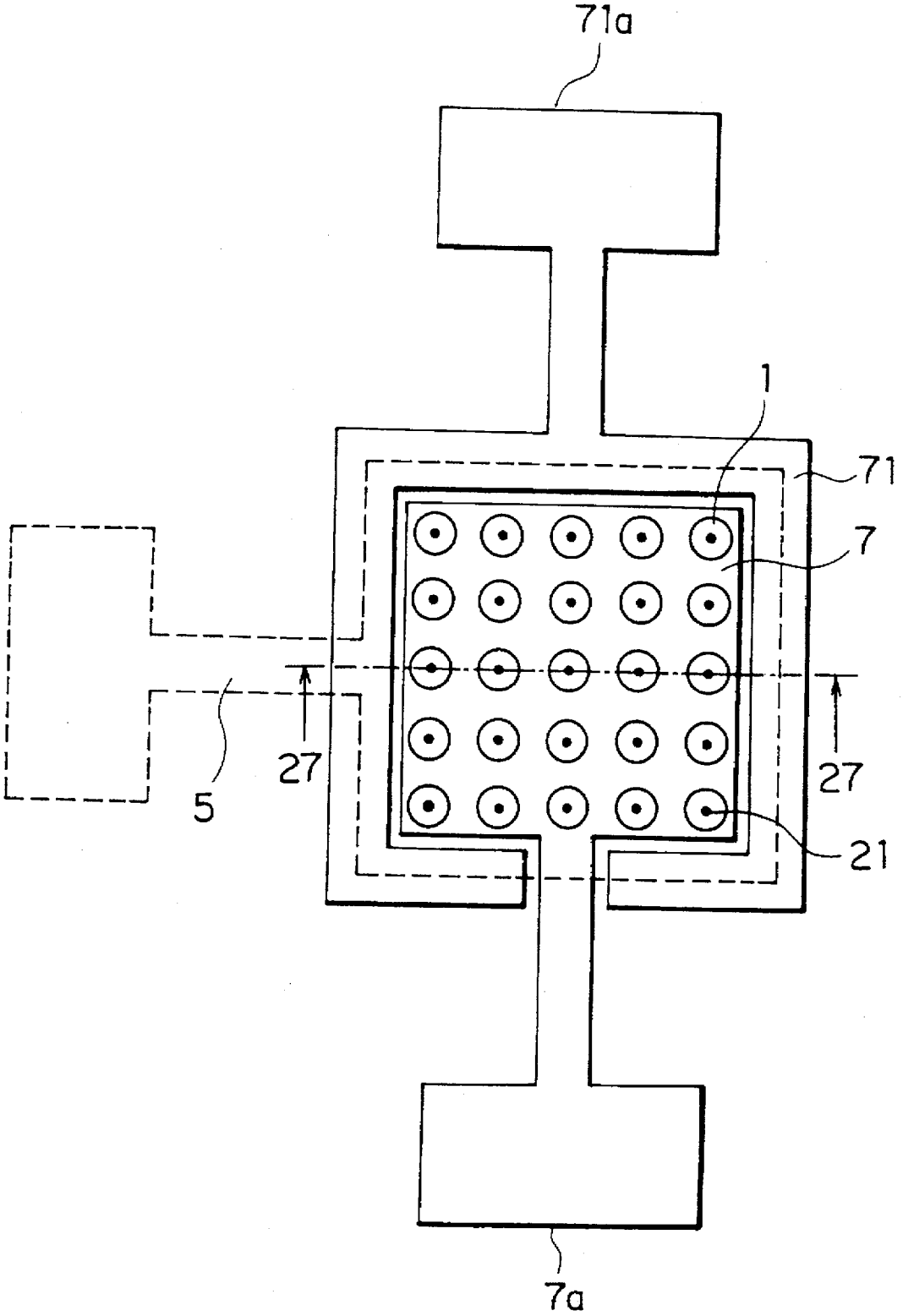
FIG. 26 is a schematic plan view of a multi-emitter electron gun of a field-emission type according to a ninth embodiment of this invention.
Figure 27:
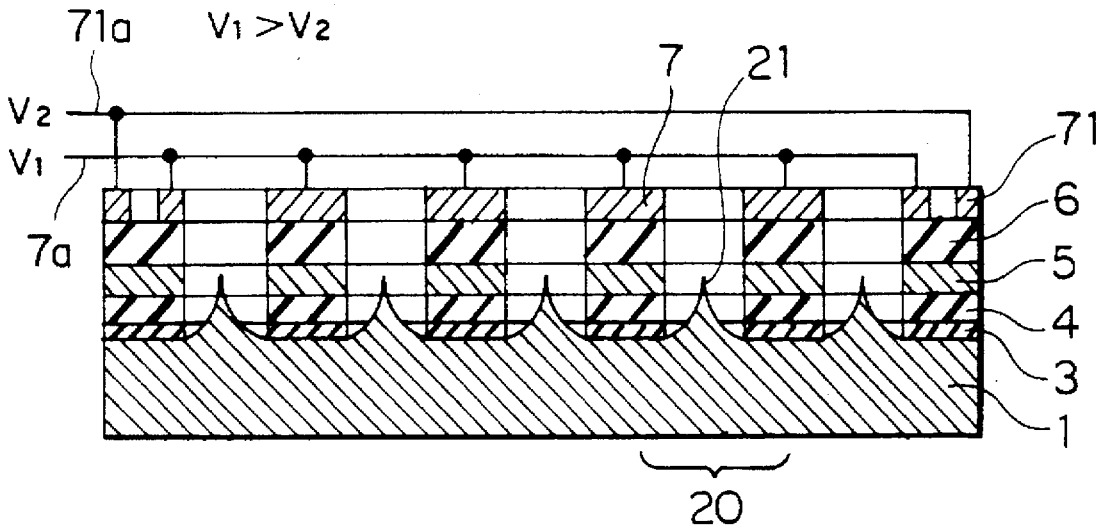
FIG. 27 is a sectional view taken along a line 27—27 in FIG. 26.

As will be understood by comparison of the present embodiment of FIGS. 26 and 27 with the prior art of FIGS. 1 and 2, the electron gun of this embodiment is the structure similar to the prior art and is further provided with a peripheral electrode 71. That is, emission electrodes 1, extracting gate electrodes 5, and focusing electrodes 7 are connected to one another to form a common emission electrode 1, a common extracting gate electrode 7 and a common focusing electrode 7, respectively, and corresponding oxide films 3, 4, and 6 of all of emitter elements are connected to one another to the common non oxide films 3, 4, and 6, respectively.

The peripheral electrode 71 is formed on the second insulation layer 6 on which the common focusing electrode is formed but encloses the common focusing electrode and extends along the periphery of the common focusing electrode with a gap left therebetween.

The common focusing electrode 7 and the peripheral electrode 71 are connected to their lead electrodes 7*a* and 71*a*, as shown in FIGS. 26 and 27.

The peripheral electrode 71 is for converging the electron beam at periphery of the region of the electron gun. Therefore, the peripheral electrode 71 will be referred to as a peripheral focusing electrode.

The peripheral focusing electrode 71 is given an electric potential V2 lower than an electric potential V1 applied to the common focusing electrode 7.

With the above-mentioned structure, in the central zone, the divergence angle of the electron beam is greater than that in the peripheral zone but the intensity of the emission current is kept relatively high. In the peripheral zone, the intensity of the emission current becomes relatively low but the divergence angle of the electron beam is relatively small.

Accordingly, taking the multi-emitter field-emission type electron gun as a whole, it is possible to suppress divergence of the output electron beam without much lowering the level of the emission current.

Figure 28:
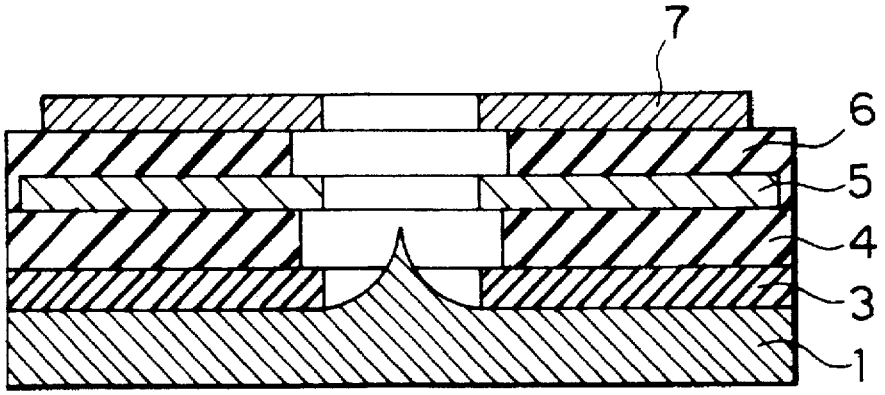
FIG. 28 shows a seventh step added to the conventional manufacturing process of FIGS. 3 through 8 in order to divide a focusing electrode in an electron-emitter element according to this invention.

If it is necessary to divide the focusing electrodes 7 in the embodiments described above, the focusing electrodes 7 may be desiredly patterned as shown in FIG. 28 after the step shown in FIG. 8.

Practically, the field-emission type multi-emitter electron gun is formed by the integrated circuit technique to have a plurality of electron-emitter elements formed on a single substrate. The substrate is provided with a plurality of the emission electrodes 1 which have the acute emissive points 21 of a conical shape distributed throughout its one surface, and a plurality of the extracting gate electrodes 5 with the holes for passage of the electrons emitted from the emissive points are formed on the substrate as a single conductive layer through an insulation layer.

As described in conjunction with the several preferred embodiments, the field-emission type electron gun according to this invention has a structure such that convergence of the electron beam emitted from the peripheral-zone electron-emitter element 20*b* is higher as compared with the electron beam emitted from the central-zone electron-emitter element 20*a*.

Figure 29:
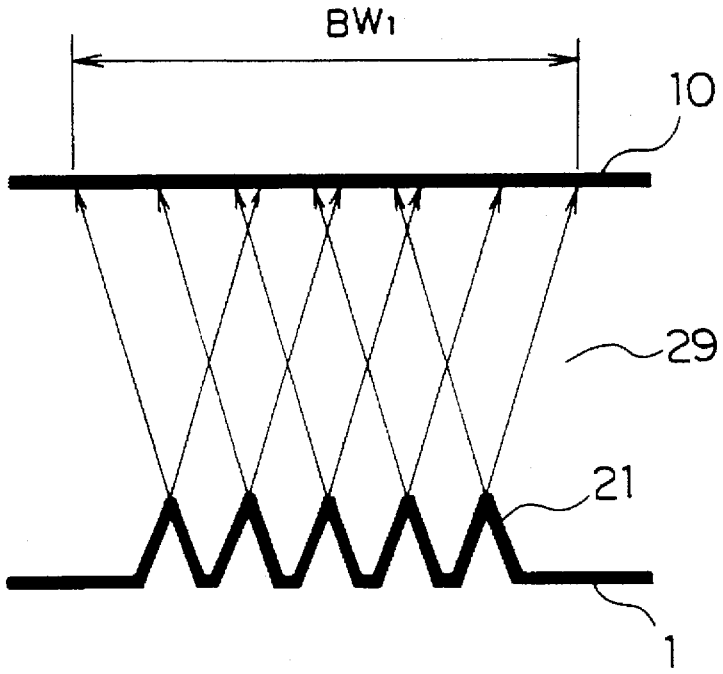
FIG. 29 schematically shows divergence of an output electron beam emitted by the known multi-emitter electron gun of a field-emission type of FIG. 2.
Figure 30:
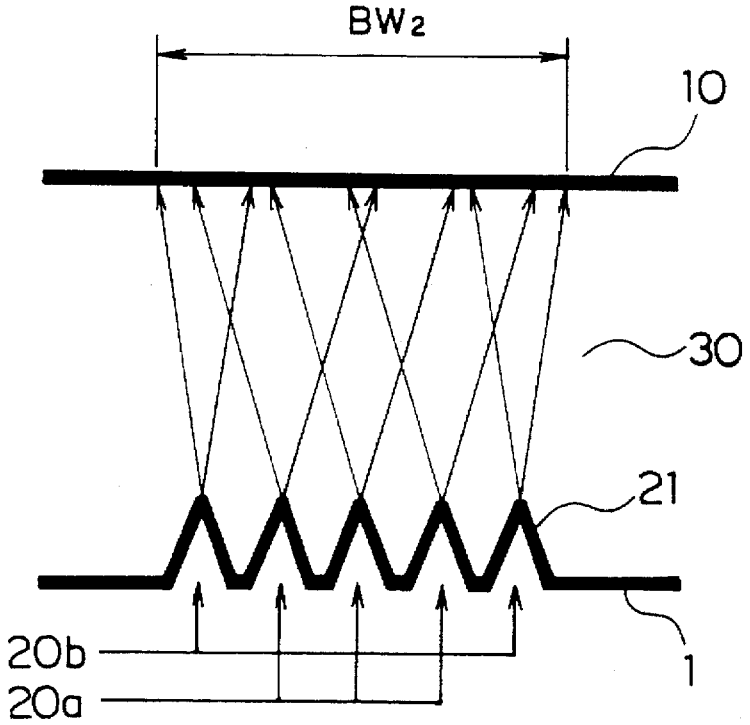
FIG. 30 schematically shows divergence of the output electron beam emitted by the multi-emitter electron gun of a field-emission type according to this invention.

FIG. 29 shows divergence of the electron beam 29 emitted by the known multi-emitter electron gun. FIG. 30 shows divergence of the electron beam 30 emitted by the multi-emitter electron gun according to this invention. As clearly understood from the figures, divergence of the electron beam is suppressed in the electron gun according to this invention as compared with the known multi-emitter electron gun.

By way of example, it is assumed that the electron beams emitted from the emissive points 21 are uniformly diverged with the divergence angle of 20 degrees. The anode electrode 10 is spaced from the electron gun by 2 mm. One edge of the matrix arrangement of the electron-emitter elements has a length of 1 mm. In this event, the electron beam emitted from the known multi-emitter electron gun is diverged on the anode electrode 10 over a width BW1 equal to 2.44 mm. On the other hand, in the multi-emitter electron gun according to this invention, convergence can be increased with respect to the electron beams emitted from the peripheral-zone electron-emitter elements 20*b* alone. It is assumed in the multi-emitter electron gun according to this invention that the divergence angle is suppressed to 12 degrees with respect to the electron beams emitted from the peripheral-zone electron-emitter elements located in the peripheral zone having the width of 0.3 mm. In this event, the electron beam is diverged over a width BW2 equal to 1.84 mm. Thus, the multi-emitter electron gun according to this invention suppresses the divergence angle of the electron beam by 25% as compared with the conventional field-emission type electron gun.

In addition, the above-mentioned effect of this invention can be further improved by a combination of two or more desired embodiments.

Although the foregoing description is directed to the matrix arrangement, the electron-emitter elements may be arranged in any other appropriate manners without restricting thereto.

What is claimed is:

1. An electron gun of a field-emission type which includes a plurality of electron-emitter elements arranged adjacent to one another within a predetermined region on a plane, wherein each of said electron-emitter elements comprises:

an emission electrode to be brought to a first electric potential and having an emissive point for emitting electrons therefrom;

an extracting gate electrode spaced at a predetermined distance from said emission electrode to be electrically insulated therefrom, said extracting gate electrode being provided with a first hole for passage of an electron beam composed of the electrons emitted from said emissive point, said extracting gate electrode being brought to a second electric potential higher than said first electric potential; and a focusing electrode spaced at a preselected interval from said extracting gate electrode downstream of the electron beam to be electrically insulated from the extracting gate electrode, said focusing electrode being provided with a second hole for passage of the electron beam after passing through said first hole, said focusing electrode being brought to a third electric potential lower than said second electric potential so as to increase convergence of the electron beam passing through said second hole;

at least one of said electron-emitter elements being different, in one of structure and amount of electric potential applied thereto, from the remaining ones of said electron-emitter elements, so as to result in a different convergence of the electron beam output therefrom.

2. An electron gun of a field-emission type as claimed in claim 1, wherein peripheral ones of said electron-emitter elements located in a peripheral zone of said region have a higher convergence of the electron beam as compared with central ones of said electron-emitter elements located in a central zone of said region.

wherein said peripheral ones of said electron-emitter elements correspond to said at least one of said electron-emitter elements, and wherein said central ones of said electron-emitter elements corresponds to said remaining ones of said electron-emitter elements.

3. An electron gun of a filed-emission type as claimed in claim 2, wherein said electron-emitter elements are classified into first-group electron-emitter elements selected from electron-emitter elements located in an outermost zone of said region and second-group electron-emitter elements which are the remaining electron-emitter elements in said region except said first-group electron-emitter elements, the focusing electrode of each of said first-group electron-emitter elements being brought to an electric potential lower than that of the focusing electrode of each of said second-group electron-emitting elements.

4. An electron gun of a field-emission type as claimed in claim 3, wherein said first-group electron-emitter elements are all except a particular one of the electron-emitter elements located in the outermost zone, and wherein said particular electron-emitter element is included in said second-group electron-emitter elements.

5. An electron gun of a field-emission type as claimed in claim 2, wherein said electron-emitter elements are electrically connected so that electric current flows from the focusing electrodes of said central-zone electron-emitter elements to the focusing electrodes of said peripheral-zone electron-emitter elements, the focusing electrodes of said peripheral-zone electron-emitter elements being brought to an electric potential lower than that of the focusing electrodes of said central-zone electron-emitter elements.

6. An electron gun of a field-emission type as claimed in claim 2, wherein the focusing electrodes of said peripheral-zone electron-emitter elements have a thickness greater than that of the focusing electrodes of said central-zone electron-emitter elements.

7. An electron gun of a field-emission type as claimed in claim 2, wherein the focusing electrodes of said peripheral-zone electron-emitter elements are smaller in a diameter of said second hole than the focusing electrodes of said central-zone electron-emitter elements.

8. An electron gun of a field-emission type as claimed in claim 2, wherein said preselected interval between said extracting gate electrode and said focusing electrode is greater in said central-zone electron-emitter elements than in said peripheral-zone electron-emitter elements.

9. An electron gun of a field-emission type as claimed in claim 2, wherein each of said electron-emitter elements An at least one zone of said peripheral zone and said central zone has one or more additional electrodes for focusing of the electron beam like said focusing electrode in the downstream of said focusing electrode, whereby each of said peripheral-zone electron-emitter elements is different from each of said central-zone electron-emitter elements in the total number of electrodes for focusing the electron beam.

10. An electron gun of a field-emission type as claimed in claim 9, wherein each of said peripheral-zone electron-emitter elements is larger than each of said central-zone electron-emitter elements in the total number of electrodes for focusing the electron beam.

11. An electron gun of a field-emission type as claimed in claim 10, wherein each of said peripheral-zone electron-emitter elements has additional focusing electrode so that the total number of electrodes for focusing of the electron beam is two, said one additional focusing electrode being brought to a fourth electric potential lower than said third electric potential, said one additional focusing electrode being arranged opposite to said extracting gate electrode with respect to said focusing electrodes with a predetermined space left from said focusing electrode to be electrically insulated therefrom.

12. An electron gun of a field-emission type as claimed in claim 2, wherein each of said central-zone electron-emitter elements further comprises an additional electrode, as an accelerating electrode, located between said extracting gate electrode and said focusing electrode, said accelerating electrode being provided with a third hole for passage of the electron beam after passing through said first hole, said accelerating electrode being brought to an electric potential not lower than said second electric potential to accelerate said electron beam passing through said third hole.

13. An electron gun of a field-emission type as claimed in claim 2, wherein said extracting gate electrode of each of said central-zone electron-emitter elements has a greater thickness as compared with that of each of said peripheral-zone electron-emitter elements.

14. An electron gun of a field-emission type as claimed in claim 2, further comprising a second focusing electrode located on the same plane as said focusing electrodes of said electron-emitter elements to be electrically insulated from said focusing electrodes and to surround all of said electron-emitter elements, said second focusing electrode being brought to an electric potential lower than that of said focusing electrodes.

15. An electron gun of a field-emission type as claimed in claim 2, wherein each of said electron-emitter elements comprises:

a first insulation film overlying said emission electrode and supporting said extracting gate electrode thereon, said first insulation film having a thickness equal to said predetermined interval in dimension and being provided with a hole corresponding to said first hole through which said emissive point is exposed; and a second insulation film overlying said extracting gate electrode and supporting said focusing electrode thereon, said second insulation film having a thickness equal to said preselected interval in dimension and being provided with a hole corresponding to said first and said second holes for passage of the electron beam.

16. An electron gun of a field-emission type as claimed in claim 15, wherein said second insulation film of each of said central-zone electron-emitter elements has a greater thickness as compared with said peripheral-zone electron-emitter elements.

17. An electron gun of a field-emission type as claimed in claim 2, further comprising:

a first single conductive plate having a plurality of sections, each section of said first single conductive plate housing a corresponding one of said emission electrodes for said electron-emitter elements, said first single conductive plate having one surface on which a plurality of conical shape projections are disposed at locations adjacent to one another, wherein said conical shape projection respectively correspond to said emissive points for said electron-emitter elements;

a second single conductive plate having a plurality of sections, each section of said second single conductive plate housing a corresponding one of said extracting gate electrodes for all said electron-emitter elements, said second single conductive plate having a plurality of first holes, wherein said first holes respectively correspond to said emissive points for said electron-emitter elements;

a first insulation film interposed between said first and said second conductive plates to provide said predetermined interval therebetween, said first insulation film having a plurality of holes corresponding to said first holes, respectively;

a second insulation film overlying said second conductive plate, said second insulating film being provided with a plurality of holes corresponding to said first holes, respectively, and having a thickness equal to said preselected interval; wherein said focusing electrode of each of said electron-emitter elements is deposited on said second insulation film with said second hole of each focusing electrode being arranged with each of said holes in said second insulation film.

18. An apparatus including an electron gun of a field-emission type emitting an output electron beam in a particular direction and having an anode electrode disposed in said particular direction of said output electron beam for predominantly collecting the output electron beam emitted from said electron gun, wherein said electron gun of a field-emission type comprises a plurality of electron-emitter elements arranged adjacent to one another in a predetermined region on a plane, each of said electron-emitter elements comprising:

an emission electrode having an emissive point for emitting electrons, said emission electrode being brought to a first electric potential;

an extracting gate electrode provided with a hole for passage of the electrons emitted from said emissive point, said extracting gate electrode being brought to a second electric potential higher than said first electric potential, said extracting gate electrode being spaced at a predetermined interval from said emission electrode to be electrically insulated therefrom; and a focusing electrode provided with a hole for passage of the electrons emitted from said emissive point, said focusing electrode being brought to an electric potential lower than said second electric potential, said focusing electrode being spaced at a preselected interval from said extracting gate electrode to be electrically insulated therefrom;

wherein peripheral ones of said electron-emitter elements located in a peripheral zone of said region have a higher convergence of the electron beam outputted therefrom as compared with central ones of said electron-emitter elements located in a central zone of said region.

19. An electron gun of a field-emission type which includes a plurality of electron-emitter elements arranged in a matrix pattern within a predetermined region on a two-dimensional plane, wherein each of said electron-emitter elements comprises:

a first electric potential;

a second electric potential higher than said first electric potential;

a third electric potential lower than said second electric potential;

an emission electrode coupled to said first electric potential, said emission electrode having an emissive point for emitting electrons therefrom;

an extracting gate electrode coupled to said second electric potential and spaced at a predetermined distance from said emission electrode to be electrically insulated therefrom, said extracting gate electrode being provided with a first hole for passage of an electron beam composed of the electrons emitted from said emissive point; and a focusing electrode coupled to said third electric potential and spaced at a preselected interval from said extracting gate electrode, at a downstream direction of the electron beam, to be electrically insulated from the extracting gate electrode, said focusing electrode being provided with a second hole for passage of the electron beam after passing through said first hole, wherein said focusing electrode increases convergence of the electron beam passing through the second hole, wherein at least one of said electron-emitter elements is different in one of: a) a size of the preselected interval, b) a thickness of the focusing electrode; and c) a diameter of the second hole, with respect to others of said electron-emitter elements, and wherein a convergence of the electron beam output from said at least one of said electron-emitter elements is different with respect to a convergence of the electron beam output from the others of said electron-emitter elements.

20. An electron gun of a field-emission type as claimed in claim 19, wherein said at least one of said electron-emitter elements comprises all of said electron-emitter elements located in a peripheral zone of said region excluding one of said electron-emitter elements located in the peripheral zone, and wherein the remaining ones of said electron-emitter elements comprises all of said electron-emitter elements located in a central zone of said region and the excluded one of said electron-emitter element located in the peripheral zone.

* * * * *